US005937598A

United States Patent [19]

Rain

[11] Patent Number: 5,937,598

[45] Date of Patent: Aug. 17, 1999

[54] WINDOW FOR PROTECTING AGAINST RADIATION

[75] Inventor: Joel Rain, Courcelles Sous Jouarre, France

[73] Assignee: Saint-Gobain Vitrage, Courbevoie, France

[21] Appl. No.: 09/023,611

[22] Filed: Feb. 13, 1998

[30] Foreign Application Priority Data

Feb. 13, 1997 [FR] France ..... 97/01665

[51] Int. Cl.[6] ..... G21C 11/00

[52] U.S. Cl. ..... 52/204.591; 52/204.62; 52/204.7; 52/204.71; 250/517.1; 250/518.1

[58] Field of Search ..... 52/204.591, 204.62, 52/204.7, 204.71; 250/515.1, 517.1, 518.1

[56] References Cited

U.S. PATENT DOCUMENTS 3,085,464 4/1963 Touvay ..... 250/517.1 X
3,283,156 11/1966 Mazza ..... 250/517.1

FOREIGN PATENT DOCUMENTS 1191502 4/1965 Germany ..... 250/517.1
1040431 8/1966 United Kingdom .

OTHER PUBLICATIONS

Patent Abstracts of Japan, vol. 014, No. 415 (P–1102), Sep. 7, 1990, JP 02 161 399, Jun. 21, 1990.

"Solid coupling eliminates oil from shielding windows," Nucleonics; vol. 24 N–11, Nov. 1966.

*Primary Examiner*—Carl D. Friedman
*Assistant Examiner*—Brian E. Glessner
*Attorney, Agent, or Firm*—Oblon, Spivak, McClelland, Maier & Neustadt, P.C.

[57] ABSTRACT

A window for protecting against the radiation from cells or chambers in nuclear plants includes at least one optical unit which provides protection against high-energy and/or neutron radiation, and a frame, the space between the optical unit and the frame being filled with a castable and hardenable material.

16 Claims, 1 Drawing Sheet

WINDOW FOR PROTECTING AGAINST RADIATION

BACKGROUND OF THE INVENTION

1. Field of the Invention

The present invention relates to a protective window, in particular one for protecting against the radiation from cells or chambers in nuclear plants. Such windows must in particular have good adsorption of high-energy radiation, such as X-rays and γ-rays, and/or good adsorption of neutron radiation.

2. Description of the Related Art

For this purpose, these windows consist, in particular, of an assembly of glass sheets which are sufficiently thick and are enriched either with heavy elements, in order to absorb X-rays and γ-rays for example, or with boron or hydrogenated products in order to absorb, in particular, neutron radiation. This assembly of glass sheets is placed in a frame and the window thus formed is positioned in the opening in a wall, the latter also being loaded with radiation-absorbent particles.

The function of such windows is to allow someone to look into a chamber, while acting as a screen for the radiation emanating from the chamber, like the rest of the walls.

In the construction of these windows, one firstly makes a stack of the glass sheets, these being bonded to each other or separated by an air cavity between two glass sheets. The assembly of glass sheets usually combines these two types of arrangement. Next, the assembly must be inserted into a metal frame which also must act as a radiation screen. This frame is normally made of cast iron so as to fulfill its screen function. When inserting the assembly of glass sheets into the frame, it is of course necessary to provide a clearance between the frame and the glass assembly so that the latter can be easily put into place. This clearance results in an empty space which must then be filled with a material which also acts as a radiation screen.

Moreover, in such constructions the glass sheets are cut to size very precisely in order to limit the clearance between said glass sheets and the frame to the minimum extent possible.

According to the techniques normally used, for example in the case of an assembly of five glass sheets, three of them are bonded together and two others are not, so as to form two air cavities. The first assembly, consisting of three bonded glass sheets, is placed in a cast-iron framework forming the window frame, the latter being placed in a horizontal position. After this stage of manufacture, the empty space due to the clearance provided between the frame and the assembly of glass sheets is filled with lead wool which also acts as a radiation screen. The lead wool is put into place manually by compacting it at each side of the frame. Since the optical axis is in a horizontal position, it allows access from both sides, thereby making it easier to put the wool into place. This step takes time, as it is necessary to compact the lead wool to the maximum extent possible so as to increase the density of the seal thus formed.

After these steps, the two non-bonded glass sheets are juxtaposed with the first assembly consisting of three glass sheets joined together, by bonding them to each other. These steps are tricky to carry out since the operator must work within the already fitted frame. After putting each glass sheet in place, it is again necessary to fill the clearance between the glass and the frame with lead wool, which again is a very lengthy step, the more so as at this stage access to compact the wool is limited to only one side of the frame.

The difficulties encountered and the time spent in producing such windows considerably increases the manufacturing costs of these windows.

SUMMARY OF THE INVENTION

It is an object of the invention to create a window providing protection against high-energy and/or neutron radiation, the construction of which is simple and requires less time than that necessary for the technique described above.

According to the invention, this object and other objects are achieved by a window comprising at least one optical unit which provides protection against high-energy and/or neutron radiation, and a frame surrounding the optical unit, the space between the optical unit and the frame being filled with a castable and hardenable material.

Such a window has many advantages at the time of its construction. In particular, the castable material, while it is being cast, fills the space or the clearance provided between the optical unit and the frame without requiring operations for compacting said material.

Another advantage associated with such a material is the ability to produce a complete optical unit before inserting it into the window frame and then to cast the castable and hardenable material. Unlike the technique mentioned earlier, it is not intended to have to complete the construction of the optical unit in the window frame.

Advantageously, the castable material is loaded with heavy and/or anti-neutron particles. Such a material may be a resin, but the radiation resistance of organic material is not satisfactory for some applications.

According to a preferred embodiment of the invention, the castable and hardenable material is a concrete, advantageously chosen so as to be identical to that making up the walls of the chamber within which the window is intended to be installed, so as to produce a level of radiation protection which is very homogeneous compared with the rest of the walls of the chamber. The concrete chosen is advantageously loaded with iron ores, in order to give it a relative density of about 4.5, and/or includes boron or hydrogenated products which absorb neutrons and/or attenuate γ-rays.

Also preferably, the concrete used includes a stoichiometric amount of water. In this way, no excess water remains, which could impair the quality of the optical unit and in particular the bonding of the glass sheets.

According to an advantageous variant of the invention, a sheet or film of impermeable material surrounds the optical unit and thus prevents any risk of contact between the optical unit and the castable material. This avoids, for example, any risk of the optical unit coming into contact with the water contained in the concrete.

According to a preferred embodiment of the invention, the optical unit has a frustopyramidal shape, i.e., one which has the shape of a pyramid, the lower and upper faces being parallel. Such a shape allows, in particular, the castable and hardenable material to flow more easily around the optical unit. In order to obtain such a unit, each glass sheet is provided with inclined edges so that the assembly of these sheets forms the frustopyramidal optical unit. According to a first embodiment, each glass sheet is provided with inclined edges having the same slope. According to a second preferred embodiment of the invention, the slopes of the inclined edges are slightly different for some of the glass sheets, the unit comprising at least two glass sheets.

According to the preferred embodiment and more particularly in the case of a plastic sheet or film surrounding the optical unit, any risk of radiation passing parallel to the inclined edge of the optical unit is eliminated. This is because a ray parallel to the edge of a first sheet will be stopped by the edge of the next sheet.

Preferably, the window frame is made of sheet metal, and therefore is inexpensive, especially compared with the usual techniques which require a cast-iron material. Advantageously, the frame has a step around its entire periphery. This step makes it possible, during installation, to place the window so as to bear on a step of complementary shape provided in the wall in which it is installed. This step in the frame is filled on its internal face with the castable material. According to another embodiment, blocks of cast-iron may also fill this step in the frame, in particular to limit the amount of castable material necessary.

In a variant of the invention, the frame of the window is used only for molding the castable material, and is then removed.

The invention also includes a process for manufacturing such windows. According to the invention, this process includes the steps of placing the optical unit produced beforehand on its large surface in the frame, the optical axis of the unit being oriented vertically, then casting the castable and hardenable material between the optical unit and the frame. According to this embodiment, the material fills the space or the clearance provided between the optical unit and the frame. No manual operation is therefore needed to compact the material at the base, this material flowing naturally. In addition, this step is simplified, or at the very least speeded up, because of a downward narrowing of the space to be filled due to the frustopyramidal shape of the optical unit.

The window according to the invention and the process for manufacturing such a window provided by the invention therefore make it possible to simplify the manufacture and decrease its cost, and results in a window providing perfect protection against high-energy and/or neutron radiation.

BRIEF DESCRIPTION OF THE DRAWINGS

Other details and advantageous features of the invention will emerge below from the description of an illustrative embodiment according to the invention, with reference to the sole FIG. 1 which schematically shows a window according to the invention in transverse section.

DETAILED DESCRIPTION OF THE PREFERRED EMBODIMENT

Figure 1:
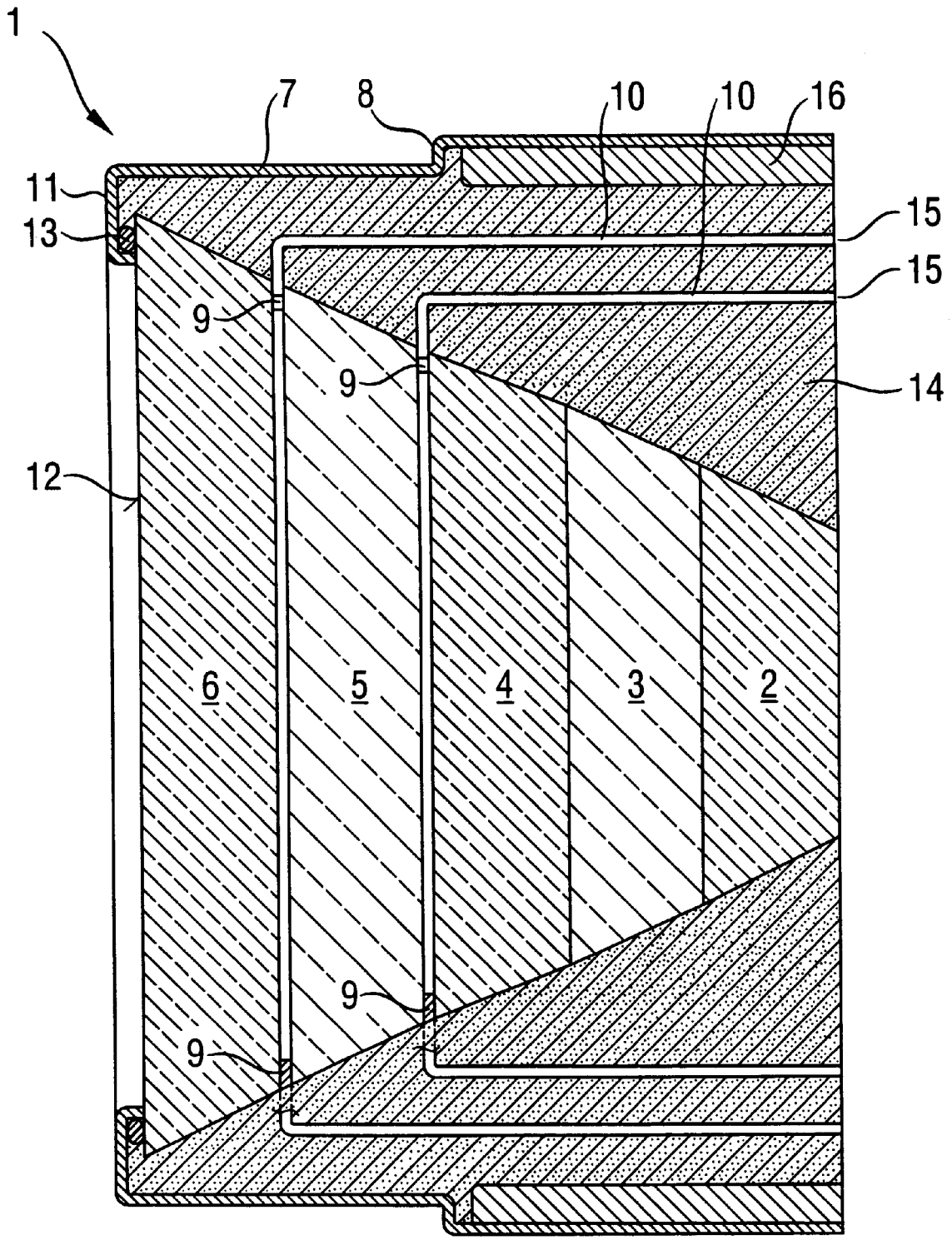

The window 1 shown in FIG. 1 has an optical unit consisting of five glass sheets 2, 3, 4, 5, 6. Each of these glass sheets has a composition providing it with protection against high-energy radiation of the γ type and/or against neutron radiation. These glass sheets each have thicknesses of between 100 and 300 mm and are joined together to form the optical unit. The glass sheets 2, 3, 4, 5, 6 have beveled edges and progressively smaller sizes so that the optical unit has a frustopyramidal shape.

The window furthermore includes a sheet-metal frame 7. This frame 7 is schematically shown by a single line in FIG. 1 and has a step 8 around its entire periphery, and therefore around the entire periphery of the window 1. This step 8 makes it possible to fit and position the window 1 in the opening in a wall 20 provided for this purpose and having a step 22 of complementary shape to that of the step 8 in the frame 7 of the window 1. The combination of these two complementary steps makes it possible for the window 1 to be fitted accurately and provides complete protection against high-energy and/or neutron radiation.

During manufacture, the optical unit is first produced by bonding together the glass sheets 2, 3 and 4 with progressively varying sizes so that their beveled peripheries form a frustopyramidal shape. These bonding operations are carried out using any method known to those skilled in the art.

Next, the glass sheets 5 and 6 are added, using a peripheral bond. This type of peripheral mounting is achieved by means of an impermeable seal 9, in the same way as for the glazing assemblies marketed under the name CLIMALIT. Again, the sheets 5 and 6 are arranged with progressively varying sizes so that their beveled peripheries continue the frustopyramidal shape.

Moreover, pipes 10 may be arranged so that their open ends terminate at the periphery of the seals 9. These pipes 10 will allow the air spaces between the glass sheets 4 and 5 and between the glass sheets 5 and 6 to be ventilated, in particular in order to eliminate any risk of fogging which would impair the light transmission. The optical unit consisting of five glass sheets 2, 3, 4, 5, 6 is thus formed. The optical unit has a frustopyramidal shape, each of the glass sheets 2, 3, 4, 5 and 6 having beveled sides.

In order to improve the light transmission further, the glass sheets, and more particularly the faces of the glass sheets which are not bonded over their entire area, may include an antireflection treatment.

Next, the operation of assembling the optical unit and the frame 7 is carried out. The frame 7 is first placed so as to rest on its rim 11 which are to clamp the surface 12 the optical unit. The optical unit is then placed within the frame 7 so as to rest on its large face 12, the latter bearing on the rim 11. The optical axis of the optical unit will thus extend vertically with its smaller end facing upward, thereby leaving a space between the optical unit and the frame 7, this space becoming progressively smaller in the downward direction. A seal of the ethylene-propylene type is provided between the rim 11 and the large face 12, ensuring that the optical unit/frame assembly is sealed.

Having fitted the optical unit in the frame 7, the operator pours concrete 14 into the space between the optical unit and the frame 7. The concrete 14 has a relative density greater than 4 and is preferably chosen to be identical to that used for the wall into which the window 1 has to be inserted. Because of its fluidity, the concrete 14 fills the entire space before hardening; in addition, expansion of the concrete 14 during hardening applies hoop stresses to the optical unit, which further ensures that the space between the frame 7 and the optical unit is completely filled.

Upon casting the concrete 14, the pipes 10 are embedded in the concrete with orifices 15 thereof projecting from the concrete 14.

In order to prevent the glass sheets 2, 3, 4, 5, 6 from being attacked by the water contained in the concrete 14, the latter is provided with a stoichiometric amount of water.

Moreover, it is also possible to provide an optional film or resin 30 surrounding the optical unit and thus eliminate any risk of its coming into contact with the water contained in the concrete 14.

In one possible embodiment of the invention, blocks of cast lead are provided around the periphery of the frame in the inner region of the frame 7 corresponding to the step 8. These blocks are optional, but they may contribute to the radiation protection in the region of said step 8.

For improving radiation protection, the slopes of the bevels of adjacent glass sheets may differ from one another such that the junction between the optical unit and the concrete 14 is not linear over the entire length of the optical unit. As a result, in the case of the presence of a plastic sheet or resin 30 surrounding the optical unit, a ray parallel to the slope of the bevel of glass sheet 6 will be absorbed by the concrete 14 or else by one of the other glass sheets.

The window 1 therefore provides effective protection against high-energy and/or neutron radiation. In addition, the construction of this window is quicker and therefore less expensive than the usual methods. In particular, the use of a castable and hardenable material such as a concrete is very rapid and fills the space provided between the frame 7 and the optical unit perfectly. Moreover, this technique has the advantage that the dimensional accuracy of the edges of the glazing assembly is not as strict as in the usual techniques since the concrete 14 will completely fill the empty space while it is being cast, and further because of the hoop stress phenomenon. It is thus possible to keep the edges of the glass sheets 2, 3, 4, 5, 6 aligned without any finishing step for removing asperities. This is because, even if there are asperities, the concrete 14 will completely cover the edges of the glass sheets. This further decreases the manufacturing cost of the window.

Obviously, numerous modifications and variations of the present invention are possible in light of the above teachings. It is therefore to be understood that the invention may be practiced otherwise than as specifically described herein.

What is claimed is:

1. A window comprising:

at least one optical unit formed of a material which provides protection against at least one of high-energy and neutron radiation;

a frame positioned around the optical unit to form a space therebetween; and a castable and hardenable material filling the space between the optical unit and the frame wherein the castable and hardenable material includes at least one of heavy particles and anti-neutron particles.

2. A window comprising:

at least one optical unit formed of a material which provides protection against at least one of high-energy and neutron radiation;

a frame positioned around the optical unit to form a space therebetween; and a castable and hardenable material filling the space between the optical unit and the frame wherein the castable material is a concrete.

3. The window as claimed in claim 2, wherein the concrete includes a stoichiometric amount of water.

4. The window as claimed in claim 1, including a sheet of liquid impermeable material surrounding the optical unit.

5. The window as claimed in claim 1, wherein the optical unit has a frustopyramidal shape.

6. A window comprising:

at least one optical unit formed of a material which provides protection against at least one of high-energy and neutron radiation;

a frame positioned around the optical unit to form a space therebetween; and a castable and hardenable material filling the space between the optical unit and the frame wherein the optical unit has a frustopyramidal shape and wherein the optical unit comprises a plurality of glass sheets having beveled edges, and wherein the slope of the beveled edges is different for at least two of the glass sheets.

7. The window as claimed in claim 1, wherein the frame is made of sheet metal.

8. The window as claimed in claim 7, wherein the frame has a step around its periphery.

9. The window as claimed in claim 1, wherein the optical unit comprises a plurality of glass sheets, at least some of which are separated by a sealed space.

10. A window comprising:

at least one optical unit formed of a material which provides protection against at least one of high-energy and neutron radiation;

a frame positioned around the optical unit to form a space therebetween;

a castable and hardenable material filling the space between the optical unit and the frame wherein the optical unit comprises a plurality of glass sheets, at least some of which are separated by a sealed space; and a device venting each said sealed space.

11. A process for manufacturing a window comprising an optical unit and a frame, comprising the steps of:

forming an optical unit;

positioning the optical unit in the frame with the optical axis of the optical unit oriented generally vertically; and casting a castable and hardenable material between the optical unit and the frame.

12. The process of claim 11, wherein said castable and hardenable material is a concrete having a relative density of at least 4.

13. The process of claim 12, wherein said concrete has a stoichiometric amount of water.

14. The process of claim 12, wherein said concrete includes at least one of boron and hydrogenated products which absorb neutrons and attenuate γ-rays.

15. The process of claim 11, wherein the optical unit is frustopyramidal with smaller and larger ends spaced along the optical axis, wherein said positioning step comprises positioning the smaller end of the optical unit generally upwardly.

16. The process of claim 11, wherein the optical unit comprises a plurality of glass sheets, at least some of which are separated by sealed spaces, including the step of providing a device for venting said sealed spaces.

* * * * *